US008598099B2

(12) United States Patent
Tipton et al.

(10) Patent No.: US 8,598,099 B2
(45) Date of Patent: Dec. 3, 2013

(54) MULTI-DISPERSANT LUBRICATING COMPOSITION

(75) Inventors: Craig D. Tipton, Perry, OH (US); James L. Sumiejski, Mentor, OH (US); William D. Abraham, Concord, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/366,711

(22) Filed: Feb. 6, 2012

(65) Prior Publication Data

US 2012/0135898 A1 May 31, 2012

Related U.S. Application Data

(63) Continuation of application No. 12/374,379, filed as application No. PCT/US2007/074316 on Jul. 25, 2007, now abandoned.

(60) Provisional application No. 60/820,516, filed on Jul. 27, 2006.

(51) Int. Cl.
*C10M 141/00* (2006.01)

(52) U.S. Cl.
USPC ..... 508/221; 508/227; 508/231; 508/232; 508/237; 508/242

(58) Field of Classification Search
USPC ..... 508/227, 231, 232, 237, 242, 221
See application file for complete search history.

(56) References Cited

U.S. PATENT DOCUMENTS

| | | | | |
|---|---|---|---|---|
| 3,502,677 | A | 3/1970 | LeSuer | |
| 4,136,043 | A * | 1/1979 | Davis | 508/231 |
| 4,857,214 | A | 8/1989 | Papay et al. | |
| 5,089,156 | A | 2/1992 | Chrisope et al. | |
| 5,164,103 | A | 11/1992 | Papay | |
| 5,256,324 | A | 10/1993 | Papay | |
| 5,344,579 | A | 9/1994 | Ohtani et al. | |
| 5,360,562 | A | 11/1994 | Chrisope et al. | |
| 5,527,478 | A | 6/1996 | Romanelli et al. | |
| 5,652,201 | A | 7/1997 | Papay et al. | |
| 5,817,605 | A | 10/1998 | Papay | |
| 5,972,851 | A | 10/1999 | Srinivasan et al. | |
| 6,103,673 | A * | 8/2000 | Sumiejski et al. | 508/186 |
| 6,528,458 | B1 | 3/2003 | Tagliamonte et al. | |
| 2003/0220206 | A1 * | 11/2003 | Komiya et al. | 508/192 |
| 2003/0224948 | A1 | 12/2003 | Dam et al. | |
| 2005/0041395 | A1 | 2/2005 | Tipton et al. | |

FOREIGN PATENT DOCUMENTS

| | | | |
|---|---|---|---|
| WO | 2005021692 | A1 | 3/2005 |
| WO | 2006091371 | A1 | 8/2006 |

OTHER PUBLICATIONS

Search Report from corresponding PCT Publication WO 2008/014319 A2 dated May 2, 2008.

Written Opinion from corresponding PCT Application No. PCT/US2007/074316 dated Feb. 29, 2008.

* cited by examiner

*Primary Examiner* — Taiwo Oladapo

(74) *Attorney, Agent, or Firm* — Michael F. Esposito, Esq.; David M. Shold, Esq.

(57) ABSTRACT

The present invention relates to a lubricating composition containing a corrosion inhibitor compound and a mixture of two or more dispersants, wherein 0 mole % to less than 50 mole % of the second dispersant molecules contain a carbocyclic ring. The invention further provides a method for lubricating a mechanical device using the lubricating composition.

13 Claims, No Drawings

MULTI-DISPERSANT LUBRICATING COMPOSITION

FIELD OF INVENTION

The present invention relates to a lubricating composition comprising a corrosion inhibitor and a mixture of two or more dispersants, where at least one of the dispersants has a carbocyclic ring present on less than 50 mole % of the dispersant molecules. The invention further provides a method for lubricating a mechanical device using the lubricating composition.

BACKGROUND OF THE INVENTION

Driveline transmissions such as gears or transmissions, especially automatic transmission fluids (ATFs), present highly challenging technological problems for satisfying the multiple and often conflicting lubricating and power transmitting requirements of modern automatic transmissions (including continuously variable transmissions of various types). Many additive components are typically included in an ATF, providing such performance characteristics as lubrication, dispersancy, friction control (for clutches), antiwear performance, anti-shudder performance, anti-corrosion and anti-oxidation performance. In some instances additive performance may be reduced in the presence of hydro-cracked basestocks such as API Group II or Group III oils. Any reduction in additive performance results in increased wear and corrosion and influences frictional characteristics. Therefore finding and providing the correctly balanced composition is a significant formulating challenge to meet industry specifications such as the Ford MERCON®-V or MERCON®-VI specifications or the General Motors specifications DEXRON®-II, DEXRON®-III or DEXRON®-SP.

Examples of formulations that have been employed in the past include those represented by U.S. Pat. No. 5,164,103, Papay, Nov. 17, 1992, which discloses preconditioned ATFs made by using a preblend formed by heating an alkenyl succinimide or succinimide detergent with a phosphorus ester and water to partially hydrolyze the ester, and then mixing the preblend and other additives with a base oil. Boronating agents may also be used. Thiadiazole derivatives may be included as another additive.

A number of other patents disclose an additive derived from the reaction of (i) alkenyl succinimide or succinimide with a phosphorus compound. These patents include U.S. Pat. No. 5,089,156 (Chrisope et al., Feb. 18, 1992 and related patent U.S. Pat. No. 5,360,562, Chrisope et al., Nov. 1, 1994), U.S. Pat. No. 5,256,324 (Papay, Oct. 26, 1993, and a division thereof: U.S. Pat. No. 5,439,606, Papay, Aug. 8, 1994), U.S. Pat. No. 5,527,478 (Romanelli et al., Jun. 18, 1996), U.S. Pat. No. 5,652,201 (Papay et al., Jul. 29, 1997), U.S. Pat. No. 5,817,605 (Papay, Oct. 6, 1998), U.S. Pat. No. 5,972,851 (Srinivasan et al. Oct. 26, 1999), U.S. Pat. No. 4,857,214 (Papay et al, Aug. 15, 1989), and U.S. Pat. No. 3,502,677 (Le Suer, Mar. 24, 1970).

U.S. Pat. No. 5,344,579, Ohtani et al, Sep. 6, 1994, discloses a friction modifier composition which may be used in a wet clutch or wet brake system. The composition comprises a hydroxyalkyl aliphatic imidazoline and a di(hydroxyalkyl) aliphatic tertiary amine. The compositions may also contain a phosphorus-containing ashless dispersant and/or a boron-containing ashless dispersant. Among other components are copper corrosion inhibitors such as 2,5-dimercapto-3,4,-thiadiazole.

U.S. Pat. No. 6,251,840, Ward, Jr. et al., Jun. 26, 2001, discloses an automatic transmission fluid comprising a majority of an oil having a certain viscosity, 0.025-5 weight percent 2,5-dimercapto-1,3,4-thiadiazole (DMTD) or one or more derivatives of DMTD, an antifoam agent, and 0.01-0.3 weight percent of 85% phosphoric acid. Derivatives of DMTD include products from combining an oil soluble dispersant with DMTD. These may be obtained by mixing a thiadiazole, preferably DMTD with an oil-soluble carboxylic dispersant in a diluent and heating the mixture above about 100° C.

U.S. Pat. No. 4,136,043, Davis, Jan. 23, 1979, discloses compositions which form homogeneous blends with lubricating oils and the like, produced by preparing a mixture of an oil-soluble dispersant and a dimercaptothiadiazole and heating the mixture above about 100° C. The compositions are useful for suppression of copper activity and "lead paint" deposition in lubricants.

US Patent Application 2003/0224948, Van Dam et al., published Dec. 4, 2003, discloses an additive formulation containing ethylene carbonate polyalkene succinimides, borated dispersants and dispersed aromatic dicarboxylic acid corrosion inhibitors that are succinimide salts of one or more aromatic dicarboxylic acids.

International Application PCT/US2006/04319, Sumiejski et al., discloses a lubricating composition containing a friction modifier, a corrosion inhibitor, an antiwear agent and a product prepared by heating a dispersant, a thiadiazole, a borating agent and optionally at least one of a 1,3- or 1,4-dicarboxylic acid and a phosphorus acid.

International Publication WO 2005/021692, Tipton et al., Aug. 21, 2003 discloses a composition containing the product prepared by heating together: (a) a dispersant and (b) 2,5-dimercapto-1,3,4-thiadiazole or a hydrocarbyl-substituted 2,5-dimercapto-1,3,4-thiadiazole which is substantially insoluble in a hydrocarbon oil of lubricating viscosity at 25° C., and further either (c) a borating agent or (d) an inorganic phosphorus compound, or both (c) and (d), said heating being sufficient to provide a reaction product of (a), (b), and (c) or (d) which is soluble in said hydrocarbon oil at 25° C. The composition further contains dibutyl hydrogen phosphite antiwear agent, calcium sulphonate detergents and friction stabilizing additive ($H_3PO_4$).

The present invention solves the problem of providing a lubricating composition, especially for an ATF capable of providing at least one property from acceptable friction performance, acceptable wear protection, acceptable corrosion resistance, acceptable anti-shudder performance, acceptable oxidation resistance and acceptable gear protection.

SUMMARY OF THE INVENTION

In one embodiment the invention provides a lubricating composition comprising:

(a) an oil of lubricating viscosity;

(b) a first dispersant comprising a product prepared by heating together:

(i) a first dispersant substrate;

(ii) a thiadiazole compound, such as, a dimercaptothiadiazole or oligomers thereof;

(iii) a borating agent; and (iv) optionally a dicarboxylic acid of an aromatic compound selected from the group consisting of 1,3 diacids and 1,4 diacids, and (v) optionally a phosphorus acid compound, said heating being sufficient to provide a product of (i), (ii), (iii) and optionally (iv) and optionally (v), which is soluble in an oil of lubricating viscosity;

(c) a second dispersant, wherein 0 mole % to less than 50 mole % of the second dispersant molecules contain a carbocyclic ring; and (d) a corrosion inhibitor such as an oil soluble 2,5-dimercapto-1,3,4-thiadiazole or a hydrocarbyl-substituted 2,5-dimercapto-1,3,4-thiadiazole derivative, other than (b).

In one embodiment the invention provides a method of lubricating a mechanical device, comprising supplying a lubricating composition described herein to the mechanical device.

DETAILED DESCRIPTION OF THE INVENTION

The present invention provides a lubricating composition and a method for lubricating a mechanical device as disclosed above.

The first dispersant may be prepared/obtained/obtainable from reaction of succinic anhydride by a Diels-Alder reaction or an "ene" reaction. The "ene" reaction mechanism and general reaction conditions are summarised in "Maleic Anhydride", pages, 147-149, Edited by B. C. Trivedi and B. C. Culbertson and Published by Plenum Press in 1982.

When the first dispersant is prepared by an "ene" reaction, 0 mole % to less than 50 mole %, or 0 to less than 30 mole % of the first dispersant molecules contain a carbocyclic ring.

The second dispersant is typically prepared/obtained/obtainable by an "ene" reaction and comprises a dispersant molecule with 0 mole % to less than 50 mole %, or 0 to less than 30 mole % of the second dispersant molecules containing a carbocyclic ring.

In one embodiment both the first and second dispersant are prepared by an "ene" reaction. The "ene" reaction may have a reaction temperature of 180° C. to less than 300° C., or 200° C. to 250° C., or 200° C. to 220° C.

Typically the first and second dispersant may be succinimide dispersants prepared by reacting a hydrocarbyl-substituted succinic anhydride with an amine (e.g., a polyamine). The first dispersant and second dispersant may independently have a carbonyl to nitrogen ratio (CO:N ratio) of 5:1 to 1:10, 2:1 to 1:10, or 1:1 to 1:10, or 1:1 to 1:5, or 1:1 to 1:2. In one embodiment the first dispersant and second dispersant both have a CO:N ratio of 1:1 to 1:10, or 1:1 to 1:5, or 1:1 to 1:2.

The weight ratio of the dispersant 2 to dispersant 1 may be 5:1 to 1:10, or 4:1 to 1:2.

(i) The First Dispersant

The product prepared by heating comprises a first dispersant. The first dispersant of the invention may be prepared from a first dispersant substrate that is well known. The first dispersant substrate includes a succinimide dispersant (for example, N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbylamine dispersant, a polyether dispersant, a polyetheramine dispersant, a viscosity modifier containing dispersant functionality (for example polymeric viscosity index modifiers (VMs) containing dispersant functionality), or mixtures thereof. Typically the first dispersant substrate includes a succinimide dispersant or a Mannich dispersant.

Generally the dispersant suitable for preparing component (b) of the present invention may be prepared as described in Examples 1-4 of International Patent Application PCT/US06/004576; or Examples 1-4 of International Publication WO2005/021692, both titled "Multifunctional Dispersants".

In several embodiments the N-substituted long chain alkenyl succinimides of (b) contain an average of at least 8, or 30, or 35 up to 350, or to 200, or to 100 carbon atoms. In one embodiment, the long chain alkenyl group is derived from a polyalkene characterised by an $\overline{M}_n$ (number average molecular weight) of at least 500. Generally, the polyalkene is characterised by an $\overline{M}_n$ of 500, or 700, or 800, or even 900 up to 5000, or to 2500, or to 2000, or even to 1500 or 1200. In one embodiment the long chain alkenyl group is derived form one or more polyolefins. The polyolefins may be, in turn, derived from monomers including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful polyolefins include polyisobutylenes having a number average molecular weight of 140 to 5000, in another instance of 400 to 2500, and in a further instance of 140 or 500 to 1500. The polyisobutylene may have a vinylidene double bond content of 5 to 69%, in a second instance of 50 to 69%, and in a third instance of 50 to 95%.

Succinimide dispersants suitable as the first dispersant substrate are described in more detail along with their methods of preparation in U.S. Pat. Nos. 4,234,435 and 3,172,892.

Mannich dispersants suitable as the first dispersant substrate include the reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, or isobutylene, which are commercially available.

(ii) The Thiadiazole Compound

The present invention further comprises a thiadiazole which is reacted as a part of the first dispersant. This is in addition to any dimercaptothiadiazole which may be present within a lubricating composition as a separate corrosion inhibitor. Examples of a thiadiazole include 2,5-dimercapto-1,3,4-thiadiazole, 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3-4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units.

The number of carbon atoms on the hydrocarbyl substituents in several embodiments range from 1 to 30, 2 to 20 or 3 to 16.

In one embodiment the thiadiazole compound, e.g., hydrocarbyl-substituted mercaptothiadizoles (as well as the unsubstituted materials), is typically substantially soluble at 25° C. in non-polar media such as an oil of lubricating viscosity. Thus, the total number of carbon atoms in the hydrocarbyl-substituents, which tend to promote solubility, will generally be 8 or more, or 10 or more, or at least 12. If there are multiple hydrocarbyl substituents, typically each substituent will contain 8 or fewer carbon atoms.

In one embodiment the thiadiazole compound, e.g., hydrocarbyl-substituted mercaptothiadazoles (as well as the unsubstituted materials), is typically substantially insoluble at 25° C. in non-polar media such as an oil of lubricating viscosity. Thus, the total number of carbon atoms in the hydrocarbyl-substituents, which tend to promote solubility, will generally be fewer than 8, or 6, or 4. If there are multiple hydrocarbyl substituents, typically each substituent will contain 4 or fewer carbon atoms.

By the term "substantially insoluble" it is meant that the thiadiazole compound e.g., a dimercaptothiadiazole (DMTD) compound, may typically dissolve to an extent of less than 0.1 weight percent, or less than 0.01 or 0.005 weight percent in oil at room temperature (25° C.). A suitable hydrocarbon oil of lubricating viscosity in which the solubility may be evaluated is Chevron™ RLOP 100 N oil. The specified amount of the DMTD or substituted DMTD is mixed with the oil and the solubility may be evaluated by observing clarity versus the appearance of residual sediment after, e.g., 1 week of storage.

Examples of a suitable thiadiazole compound include those disclosed below in the corrosion inhibitor definition. In one embodiment the thiadiazole compound includes a hydrocarbyl-substituted 2,5-dimercapto-1,3-4-thiadiazole comprising at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

(iii) Borating Agent

The borating agent includes various forms of boric acid (including metaboric acid, $HBO_2$, orthoboric acid, $H_3BO_3$, and tetraboric acid, $H_2B_4O_7$), boric oxide, boron trioxide, and alkyl borates, such as those of the formula $(RO)_xB(OH)_y$ wherein x is 1 to 3 and y is 0 to 2, the sum of x and y being 3, and where R is an alkyl group containing 1 to 6 carbon atoms. In one embodiment, the boron compound is an alkali or mixed alkali metal and alkaline earth metal borate. These metal borates are generally hydrated particulate metal borates which are known in the art. In one embodiment the metal borates include mixed alkali and alkaline earth metal borates. These metal borates are available commercially.

(iv) Dicarboxylic Acid of an Aromatic Compound

In one embodiment the first dispersant further comprises a 1,3-dicarboxylic acid or 1,4-dicarboxylic acid of an aromatic compound, or reactive equivalents thereof, or mixtures thereof. The 1,3-dicarboxylic acid or 1,4-dicarboxylic acid is reacted or complexed with the first dispersant. The term "reactive equivalents thereof" includes acid halides, esters, amides or mixtures thereof. The "aromatic component" of the 1,3-dicarboxylic acid or 1,4-dicarboxylic acid is typically a benzene (phenylene) ring or a substituted benzene ring, although other aromatic materials such as fused ring compounds or heterocyclic compounds are also contemplated. It is believed (without intending to be bound by any theory) that the dicarboxylic acid aromatic compound may be bound to the first dispersant by salt formation or complexation, rather than formation of covalently bonded structures such as amides, which may also be formed but may play a less important role. Typically the presence of the dicarboxylic acid aromatic compound within the present invention is believed to impart corrosion inhibition properties to the composition. Examples of suitable dicarboxylic acids include 1,3-dicarboxylic acids such as isophthalic acid and alkyl homologues such as 2-methyl isophthalic acid, 4-methyl isophthalic acid or 5-methyl isophthalic acid; and 1,4-dicarboxylic acids such as terephthalic acid and alkyl homologues such as 2-methyl terephthalic acid. Other ring substituents such as hydroxy or alkoxy (e.g., methoxy) groups may also be present in certain embodiments. In one embodiment the aromatic compound is terephthalic acid.

(v) Phosphorus Acid Compound

In one embodiment the first dispersant is optionally prepared in the presence of a phosphorus acid compound. The phosphorus acid compound may contain an oxygen atom and/or a sulfur atom as its constituent elements, and is typically a phosphorus acid or anhydride. This component includes the following examples: phosphorous acid, phosphoric acid, hypophosphorous acid, polyphosphoric acid, phosphorus trioxide, phosphorus tetroxide, phosphorus pentoxide ($P_2O_5$), phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid or their anhydrides are typically used. A salt, such as an amine salt of a phosphorus acid compound may also be used. It is also possible to use a plurality of these phosphorus acid compounds together. The phosphorus acid compound is often phosphoric acid or phosphorous acid or their anhydride.

The phosphorus acid compound may also include phosphorus compounds with a phosphorus oxidation of +3 or +5, such as phosphates, phosphonates, phosphinates, or phosphine oxides. A more detailed description for these suitable phosphorus acid compounds is given in U.S. Pat. No. 6,103,673, column 9, line 64 to column 11, line 8.

The amount of the first dispersant present in the lubricating composition may be in ranges of 0.1 wt % to 10 wt %, or 0.2 wt % to 7 wt %, or 0.3 wt % to 6 wt % of the lubricating composition.

The Second Dispersant

The second dispersant includes a succinimide dispersant (for example N-substituted long chain alkenyl succinimides), an ester-containing dispersant, a condensation product of a fatty hydrocarbyl monocarboxylic acylating agent with an amine or ammonia, a hydrocarbyl-amine dispersant, a polyether dispersant, a polyetheramine dispersant, a viscosity modifier containing dispersant functionality (for example polymeric viscosity index modifiers (VMs) containing dispersant functionality), or mixtures thereof. Typically the second dispersant is a succinimide dispersant.

In one embodiment the second dispersant may be a multifunctional dispersant prepared by heating (i) a dispersant substrate; (ii) a borating agent; and (iii) optionally a dicarboxylic acid of an aromatic compound selected from the group consisting of 1,3 diacids and 1,4 diacids, and (iv) optionally a phosphorus acid compound, said heating being sufficient to provide a product of (i), (ii), and optionally (iii), which is soluble in an oil of lubricating viscosity. Typically a multifunctional dispersant of this type (i.e. the second dispersant) is not prepared in the presence of 2,5-dimercapto-1,3,4-thiadiazole, or a 2,5-dimercapto-1,3,4-thiadiazole derivative.

The second dispersant is typically described in a similar way to the first dispersant substrate (defined above) or the multifunctional dispersant described immediately above, except the second dispersant has 0 mole % to less than 50 mole % of the second dispersant molecules containing a carbocyclic ring. In one embodiment the second dispersant has 0 mole % to less than 20 mole % of the second dispersant molecules containing a carbocyclic ring. In one embodiment the second dispersant has 0 mole % of the second dispersant molecules containing a carbocyclic ring The amount of the second dispersant present in the lubricating composition may be in ranges of 0.1 wt % to 10 wt %, or 0.2 wt % to 7 wt %, or 0.3 wt % to 6 wt % of the lubricating composition.

Corrosion Inhibitor

The lubricating composition further comprises a corrosion inhibitor or mixtures thereof. In one embodiment the corrosion inhibitor also exhibits antiwear properties.

In several embodiments the amount of corrosion inhibitor present in the lubricating composition ranges from 0.001 wt % to 10 wt %, 0.005 wt % to 5 wt %, 0.01 wt % to 3 wt % or 0.02 wt % to 2 wt % of the lubricating composition.

The corrosion inhibitors of the invention include benzotriazoles (typically tolyltriazole), 2-alkyldithiobenzimidazoles or 2-alkyldithio benzothiazoles, 1,2,4-triazoles, benzimidazoles, octylamine octanoate, condensation products of dodecenyl succinic acid or anhydride, dimercaptothiadiazoles and reactive equivalents thereof, or mixtures thereof.

The corrosion inhibitor may comprise at least one of a dimercaptothiadiazole, 5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole. Typically readily available materials such as 2,5-dimercapto-1,3-4-thiadiazole or a hydrocarbyl-substituted 2,5-dimercapto-1,3-4-thiadiazole are commonly utilised, with 2,5-dimercapto-[1,3,4]-thiadiazole most commonly utilised due to availability. In several embodiments the number of carbon atoms on the hydrocarbyl-substituent group includes 1 to 30, 2 to 25, 4 to 20, 6 to 16, or 8 to 10.

In one embodiment, the thiazole compound may be the reaction product of a phenol with an aldehyde and a dimercaptothiadiazole. The phenol may be an alkyl phenol wherein the alkyl group contains at least about 6, e.g., 6 to 24, or 6, or 7, to 12 carbon atoms. The aldehyde may be an aldehyde containing 1 to 7 carbon atoms or an aldehyde synthon, such as formaldehyde. In one embodiment, the aldehyde is formaldehyde or paraformaldehyde. The aldehyde, phenol and dimercaptothiadiazole are typically reacted by mixing them at a temperature up to about 150° C. such as 50° C. to 130° C., in molar ratios of 0.5 to 2 moles of phenol and 0.5 to 2 moles of aldehyde per mole of dimercaptothiadiazole. In one embodiment, the three reagents are reacted in equal molar amounts. The product may be described as an alkylhydroxyphenylmethylthio-substituted [1,3,4]-thiadiazole; the alkyl moiety may be, among others, hexyl, heptyl, octyl, or nonyl.

Useful thiadiazole compounds thus may include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles, and mixtures thereof.

Examples of suitable thiadiazole compounds include 2-octyldithio-5-mercapto-1,3,4-thiadiazole, 2-nonyldithio-5-mercapto-1,3,4-thiadiazole, 2-dodecydithio-5-mercapto-1,3,4-thiadiazole, 2,5-dimercapto-1,3-4-thiadiazole and 2,5-bis(alkyl-dithio)-1,3,4-thiadiazoles including 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof. In one embodiment the hydrocarbyl-substituted 2,5-dimercapto-1,3-4-thiadiazole comprises at least one of 2,5-bis(tert-octyldithio)-1,3,4-thiadiazole 2,5-bis(tert-nonyldithio)-1,3,4-thiadiazole, or 2,5-bis(tert-decyldithio)-1,3,4-thiadiazole.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and rerefined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, and percolation.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils (e.g., lard oil), vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. In one embodiment the oil of lubricating viscosity may be an API Group I, Group II, Group III, Group IV oil or mixtures thereof. In one embodiment the oil of lubricating viscosity may be an API Group II, Group III or Group IV oil or mixtures thereof. In one embodiment the oil of lubricating viscosity may be an API Group II or Group III oil or mixtures thereof.

The oil of lubricating viscosity may have a sulphur content in ranges of 0 ppm to 1000 ppm, or 0 ppm to 500 ppm, or 0 or 1 ppm to 300 ppm.

The oil of lubricating viscosity may have an aromatic content of 0 wt % to 10 wt %, or 0 wt % to 5 wt %, or 0 or 0.1 wt % to 2 wt % of the oil of lubricating viscosity.

The oil of lubricating viscosity may have a viscosity index of 105 or more, 108 or more, or 110 or more (as determined by ASTM method D2270).

In one embodiment the oil of lubricating viscosity may have a sulphur content of 0 ppm to 1000 ppm, an aromatic content of 0 wt % to 10 wt % and a viscosity index of at least 105. Examples of such an oil of lubricating viscosity include Yubase-3, Yubase-6, or Korean S-3 (3 $mm^2/s$) and S-8 (8 $mm^2/s$) base oils.

The amount of the oil of lubricating viscosity present is typically the balance remaining after subtracting from 100 wt % the sum of the amount of the first dispersant, the second dispersant, the corrosion inhibitor and the other performance additives (described below).

The lubricating composition may be in the form of a concentrate and/or a fully formulated lubricant. If the first dispersant, the second dispersant, the corrosion inhibitor and the other performance additives are in the form of a concentrate (which may be combined with additional oil to form, in whole or in part, a finished lubricant), the ratio of the of components (a), (b) and (c) (i.e. the first dispersant, the second dispersant and the corrosion inhibitor) to the oil of lubricating viscosity and/or to diluent oil include the ranges of 1:99 to 99:1 by weight, or 80:20 to 10:90 by weight.

Other Performance Additive

The composition of the invention optionally further includes at least one other performance additive. The other performance additives include detergents, viscosity index improvers (also referred to as viscosity modifiers), antiwear agents, friction modifiers, friction stabilising agents, antioxidants, foam inhibitors, demulsifiers, pour point depressants, seal swelling agents and mixtures thereof.

Antiwear Agent

The antiwear agent may be a phosphorus-containing acid, salt or ester or mixtures thereof.

The antiwear agent may be metal-containing or metal free (prior to being mixed with other components).

The antiwear agent may be derived from a phosphoric acid, phosphorous acid, thiophosphoric acid, thiophosphorous acid, or mixtures thereof.

The antiwear agent may include (i) a non-ionic phosphorus compound; (ii) an amine salt of a phosphorus compound; (iii) an ammonium salt of a phosphorus compound; (iv) a monovalent metal salt of a phosphorus compound, such as a metal dialkyldithiophosphate or a metal dialkylphosphate; or (v) mixtures of (i), (ii), (iii) or (iv).

In one embodiment the antiwear agent comprises a metal dialkyldithiophosphate or a metal dialkylphosphate. The alkyl groups of the dialkyldithiophosphate and/or the dialkylphosphate may be linear or branched containing 2 to 20 carbon atoms, provided that the total number of carbons is sufficient to make the metal dialkyldithiophosphate oil soluble. The metal of the metal dialkyldithiophosphate and/or dialkylphosphate typically includes monovalent or divalent metals. Examples of suitable metals include sodium, potassium, copper, calcium, magnesium, barium or zinc. In one embodiment the antiwear agent is a zinc dialkyldithiophosphate. In one embodiment the antiwear agent is a zinc dialkylphosphate.

Examples of a suitable zinc dialkyldithiophosphate (often referred to as ZDDP, ZDP or ZDTP) include zinc di-(amyl) dithiophosphate, zinc di-(1,3-dimethylbutyl) dithiophosphate, zinc di-(heptyl) dithiophosphate, zinc di-(octyl) dithiophosphate di-(2-ethylhexyl) dithiophosphate, zinc di-(nonyl) dithiophosphate, zinc di-(decyl) dithiophosphate, zinc di-(dodecyl) dithiophosphate, zinc di-(dodecylphenyl) dithiophosphate, zinc di-(heptylphenyl) dithiophosphate, or mixtures thereof. In one embodiment the zinc dialkyldithiophosphate comprises a mixed alkyl ZDDP compound, wherein the alkyl groups include 2-methylpropyl and amyl. In one embodiment the zinc dialkyldithiophosphate comprises a mixed alkyl ZDDP compound, wherein one alkyl group comprises isopropyl and at least one of 1,3-dimethylbutyl, 2-ethylhexyl and iso-octyl.

In one embodiment the antiwear agent is other than metal dialkyldithiophosphate.

In one embodiment the antiwear agent comprises an ammonium or amine salt of a phosphorus-containing acid or ester.

The amine salt of a phosphorus acid or ester includes phosphoric acid esters and amine salts thereof dialkyldithiophosphoric acid esters and amine salts thereof; amine salts of phosphites; and amine salts of phosphorus-containing carboxylic esters, ethers, and amides; and mixtures thereof.

The amine salt of a phosphorus acid or ester may be used alone or in combination. In one embodiment the antiwear agent is derived from an amine salt of a phosphorus compound, or mixtures thereof.

In one embodiment the amine salt of a phosphorus acid or ester includes a partial amine salt-partial metal salt compounds or mixtures thereof. In one embodiment the amine salt of a phosphorus acid or ester further comprises a sulphur atom in the molecule.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, di-cocoalkyl amine (or di-cocoamine) and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the amine salt of a phosphorus acid or ester includes an amine with C11 to C14 tertiary alkyl primary groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid or ester is the reaction product of a $C_{14}$ to $C_{18}$ alkylated phosphoric acid with Primene 81R™ (produced and sold by Rohm & Haas) which is a mixture of C11 to C14 tertiary alkyl primary amines.

Examples of the amine salt of a phosphorus acid or ester include the reaction product(s) of isopropyl, methyl-amyl (1,3-dimethylbutyl or mixtures thereof), 2-ethylhexyl, heptyl, octyl or nonyl dithiophosphoric acids with ethylene diamine, morpholine, or Primene 81R™, and mixtures thereof.

In one embodiment a dithiophosphoric acid may be reacted with an epoxide or a glycol. This reaction product is further reacted with a phosphorus acid, anhydride, or lower ester (where "lower" signifies 1 to 8, or 1 to 6, or 1 to 4, or 1 to 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols may be aliphatic glycols having 1 to 12, or 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(1,3-dimethylbutyl)phosphorodithioate (prepared by reacting di(1,3-dimethylbutyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

In one embodiment the antiwear agent comprises a non-ionic phosphorus compound. Typically the non-ionic phosphorus compound may have an oxidation of +3 or +5. The different embodiments comprise phosphite ester, phosphate esters, or mixtures thereof.

In one embodiment the antiwear agent comprises a non-ionic phosphorus compound that is a hydrocarbyl phosphite. The hydrocarbyl phosphite of the invention includes those represented by the formula:

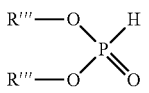

(I)

wherein each R''' may be independently hydrogen or a hydrocarbyl group, with the proviso that at least one of the R''' groups is hydrocarbyl.

Each hydrocarbyl group of R''' may contain at least 2 or 4 carbon atoms. Typically, the combined total sum of carbon atoms present on both R''' groups may be less than 45, less than 35 or less than 25. Examples of suitable ranges for the number of carbon atoms present on both R''' groups includes 2 to 40, 3 to 24 or 4 to 20. Examples of suitable hydrocarbyl groups include propyl, butyl, pentyl, hexyl dodecyl, butadecyl, hexadecyl, or octadecyl groups. Generally the hydrocarbyl phosphite is soluble or at least dispersible in oil. In one embodiment the hydrocarbyl phosphite may be di-butyl hydrogen phosphite or a $C_{16-18}$ alkyl hydrogen phosphite. A more detailed description of the non-ionic phosphorus compound is found in column 9, line 48 to column 11, line 8 of U.S. Pat. No. 6,103,673.

The antiwear agent may be present in an amount sufficient to provide 0.01 wt % to 0.5 wt %, or 0.02 wt % to 0.2 wt % phosphorus to the lubricating composition.

The antiwear agent may be present at 0.01 wt % to 20 wt %, or 0.05 wt % to 10 wt %, or 0.1 wt % to 5 wt % of the lubricating composition.

Antioxidants

In one embodiment the lubricating composition further comprises an antioxidant. The antioxidant may be present in ranges of 0 wt % to 10 wt %, 0.01 wt % to 5 wt %, or 0.05 wt % to 3 wt % of the lubricating composition.

Suitable antioxidants include molybdenum compounds such as molybdenum dithiocarbamates, sulphurised olefins, sulphides (including hydroxylalkyl sulphides such as 1-(tert-dodecylthio)-2-propanol or tert-nonyl mercaptan reacted with propylene oxide (mole ratio 1:1)), hindered phenols including ester-substituted hindered phenols, aminic compounds such as phenylalphanaphthylamines or alkylated diphenylamines (typically nonyl diphenylamine, di-nonyl diphenylamine, octyl diphenylamine, di-octyl diphenylamine), or mixtures thereof.

Friction Modifiers

In one embodiment the lubricating composition further comprises a friction modifier. The friction modifiers may be present in ranges of 0 wt % to 5 wt %, or 0.1 wt % to 4 wt %, or 0.25 wt % to 3.5 wt %, or 0.5 wt % to 2.5 wt %, or 1 wt % to 2.5 wt % of the lubricating composition.

The friction modifiers may include fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates, condensation products of carboxylic acids or polyalkylene-polyamines, or amides of hydroxyalkyl compounds.

In one embodiment the friction modifier may be a fatty acid ester of glycerol, e.g., partial esters. The final product may be in the form of a metal salt, an amide, an imidazoline, or mixtures thereof. The fatty acids may contain 6 to 24 or 8 to 18 carbon atoms. The fatty acids may branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid is oleic acid. When in the form of a metal salt, typically the metal may be zinc or calcium and the products may be overbased. The zinc salts may be acidic, neutral or basic (overbased). These zinc carboxylates (in particular zinc oleate) are known in the art and are described in U.S. Pat. No. 3,367,869.

When in the form of an amide, the condensation product may be prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier is the condensation product of a C8 to C24 fatty acid with a polyalkylene polyamine, and in particular, the product of isostearic acid with tetraethylenepentamine.

In one embodiment the friction modifier may be formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, and 19-21. The friction modifier disclosed in U.S. Patent Application 60/725,360 may be an amide represented by the formula $R^1R^2N$—C (O)$R^3$, wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 68 and 69 of U.S. Patent Application 60/725,360). In one embodiment the amide of a hydroxylalkyl compound is prepared by reacting glycolic acid, that is, hydroxyacetic acid, HO—$CH_2$—COOH with an amine.

In one embodiment the friction modifier may be a secondary or tertiary amine being represented by the formula $R^4R^5NR^6$, wherein $R^4$ and $R^5$ are each independently an alkyl group of at least 6 carbon atoms and $R^6$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment the friction modifier may be a reaction product of a di-cocoalkyl amine (or di-cocoamine) with glycolic acid. The friction modifier may be prepared by the Preparative Examples 1 and 2.

In one embodiment the friction modifier may be derived from the reaction product of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in US Patent Application 2003/22000 (or International Publication WO04/007652) in paragraphs 8 and 9 to 14.

In one embodiment the friction modifier may be an alkoxylated alcohol. A detailed description of suitable alkyoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier may be a hydroxylamine compound as defined in column 37, line 19, to column 39, line 38 of U.S. Pat. No. 5,534,170. Optionally the hydroxylamine may be borated as such products are described in column 39, line 39 to column 40 line 8 of U.S. Pat. No. 5,534,170.

In one embodiment the friction modifier may be an alkoxylated amine e.g., an ethoxylated amine derived from 1.79% Ethomeen T-12 and 0.90% Tomah PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-cocoamine); ETHOMEEN™ C/20 (polyoxyethylene[10]cocoamine); ETHOMEEN™ S/12 (bis[2-hydroxyethyl]soyamine); ETHOMEEN™ T/12 (bis[2-hydroxyethyl]allow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl]octadecylamine); and ETHOMEEN™ 18/25 (polyoxyethylene[15] octadecylamine). Fatty amines and ethoxylated fatty amines are also described in U.S. Pat. No. 4,741,848.

In one embodiment the friction modifier may be a polyol ester as described in U.S. Pat. No. 5,750,476 column 8, line 40 to column 9, line 28.

In one embodiment the friction modifier may be a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment the friction modifier may be a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663. Typically the isomerised alkenyl group is derived from a reaction product of an isomerised alpha-olefin with an acid catalyst followed by reaction with maleic anhydride. The alkenyl group may contain 8 to 20 carbon atoms.

In one embodiment the friction modifier may be an alkylphosphonate mono- or di-ester sold commercially by Rhodia under the trademark Duraphos® DMODP.

In one embodiment the friction modifier may be a borated fatty epoxide, known from Canadian Patent No. 1,188,704. These oil-soluble boron-containing compositions are prepared by reacting, at a temperature from 80° C. to 250° C., boric acid or boron trioxide with at least one fatty epoxide. The fatty epoxide typically contains at least 8 carbon atoms in the fatty groups of the epoxide.

The borated fatty epoxides may be characterised by the method for their preparation which involves the reaction of two materials. Reagent A may be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid. Reagent B may be at least one fatty epoxide. The molar ratio of reagent A to reagent B is generally 1:0.25 to 1:4, or 1:1 to 1:3, or about 1:2. The borated fatty epoxides may be prepared by merely blending the two reagents and heating them at temperature of 80° to 250° C., or 100° to 200° C., for a period of time sufficient for reaction to take place. If desired, the reaction may be effected in the presence of a substantially inert, normally liquid organic diluent. During the reaction, water is evolved and may be removed by distillation.

Friction Stabilising Agents

In one embodiment the lubricating composition further comprises a friction stabilising agent. Friction stabilising agents include $H_3PO_4$, $H_3PO_3$ or mixtures thereof. Typically $H_3PO_4$ is commercially available in 85% solution in water. The friction stabilising agents may be present in ranges of 0 wt % to 2 wt %, 0.01 wt % to 1 wt %, 0.01 wt % to 0.5 wt %, 0.02 wt % to 0.25 wt %, or 0.03 wt % to 0.2 wt %.

Viscosity Modifiers

In one embodiment the lubricating composition further comprises a viscosity modifier or dispersant viscosity modifier (also referred to as DVMs). The viscosity modifier may be present at 0 wt % to 12 wt %, 0.1 wt % to 10 wt % or 1 wt % to 8 wt % of the lubricating composition.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl aryl conjugated diene copolymers, polyolefins, and esters of maleic anhydride-styrene copolymers.

Dispersant viscosity modifiers include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; may also be used in the composition of the invention.

Detergents

In one embodiment the lubricating composition further comprises a detergent. The detergents may be present in ranges of 0 wt % to 8 wt %, 0.01 wt % to 6 wt % or 0.05 wt % to 4 wt % of the lubricating composition.

Detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a saligenin, an alkylsalicylate, and a salixarate. The alkaline earth metal may be calcium, magnesium or barium. In different embodiments the detergent may be a magnesium sulphonate or a calcium sulphonate.

Foam inhibitors including polydimethyl siloxane, fluorosilicone, copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene copolymers, polymethacrylates, polyacrylates or polyacrylamides; and seal swell agents including phthalate esters, 3-(decyloxy) tetrahydro-1,1-dioxide thiophene, decyloxysulpholane, Exxon Necton-37™ (FN 1380) and Exxon Mineral Seal Oil (FN 3200) may also be present in the lubricating composition. Typically the amount of foam inhibitors, demulsifiers, pour point depressants, and seal swell agents are independently in ranges of 0 wt % to 0.5 wt %, or 0.0001 wt % to 0.3 wt %.

Industrial Application

The method of the invention is useful for lubricating a variety of mechanical devices. The mechanical device comprises at least one of a gear, a gearbox, a traction drive transmission, an automatic transmission or a manual transmission. In one embodiment the mechanical device is an automatic transmission.

The automatic transmission includes continuously variable transmissions (CVT), infinitely variable transmissions (IVT), Toridal transmissions, continuously slipping torque converter clutches (CSTCC), stepped automatic transmissions or dual clutch transmissions (DCT).

The following examples provide illustrations of the invention. These examples are non-exhaustive and are not intended to limit the scope of the invention.

EXAMPLES

Preparative Example 1

Armeen™2C, dicocoamine, from Akzo, 468.2 g (1.2 equivalents) is added to a vessel equipped with a mechanical stirrer, nitrogen inlet, thermocouple, and Dean-Stark trap with a condenser. The vessel and its contents are heated to 80° C. with stirring. To the vessel is added 130.4 g glycolic acid, 70% in water, from TCI (1.2 equivalents), via an addition funnel over 20 minutes. The reaction mixture is heated to 180° C. over a 2 hour period while collecting distillate. The mixture is held at 180° C. for an additional 5½ hours, then cooled overnight. Thereafter, the mixture is heated to 70° C. and 20 g filter aid is added. The mixture is stirred for 15 minutes and filtered through a cloth pad. The reaction product is a clear light-amber liquid filtrate, 503.6 g, having an analysis of 3.15% N, TBN 9.57, and TAN 1.75.

Preparative Example 2

The procedure of Preparative Example 1 is substantially repeated, except that the amine used is the corresponding amount of Armeen™ HTL8 (a (2-ethylhexyl)(hydrogenated tallow) amine).

Preparative Example 3

1950 g of Armeen™2C, dicocoamine, from Akzo, 586 g of chloroglycerine and 562 g of sodium carbonate are added to a 5 L 4-neck flask equipped with a mechanical stirrer, nitrogen inlet, thermocouple, and Dean-Stark trap with a condenser. The vessel is heated to 80° C. and held for 4 hours, followed by heating to 90° C. and holding for a further 4 hours. The vessel is then cooled overnight. The vessel is then reheated to 90° C. and held for a further 4 hours. The vessel is then held under vacuum at 120° C. for 30 minutes. The contents of the vessel are cooled to ambient before filtering over FAX-5 cloth pad. The final product yield is 82%.

Preparative Examples 4-7 are the same as Examples 1-4 of PCT/US06/004576 respectively.

Preparative Example 4

A reaction vessel with a 4-neck round bottom flask fitted with a mechanical stirrer, subsurface nitrogen sparge, thermowell, and Dean-Stark trap fitted with a condenser vented to caustic and bleach traps is charged with 2137 g succinimide dispersant (reaction product of polyisobutylene substituted succinic anhydride with polyethylene amine bottoms, containing diluent oil) and 1422 g additional diluent oil and is heated, with stirring, to 83° C. and 114 g of boric acid is added before heating to 152° C. over 2.5 hours and water is removed. To the mixture is added 1.16 g of terephthalic acid and the mixture is heated to 160° C. At 160° C. 25.2 g of 2,5-dimercapto-1,3,4-thiadiazole (DMTD) in portions such that each subsequent addition is effected after the previous portion has dissolved. The mixture is stirred until evolution of $H_2S$ ceases before filtration to produce a final product.

Preparative Example 5

Preparative Example 4 is substantially repeated except that 77.8 g phosphorous acid is added along with the boric acid.

Preparative Example 6

Preparative Example 4 is substantially repeated except that the dispersant is a Mannich dispersant.

Preparative Example 7 is substantially the same as Preparative Example 5, except 85% $H_3PO_4$ is used instead of phosphorous acid.

Preparative Example 8 is similar to Preparative Example 4, except the DMTD material is not present in the reaction.

Lubricating compositions are prepared as is shown in the table below. The lubricating compositions of the invention are LC1 and LC2. Comparative lubricating compositions are REF1 and REF2. All the lubricating compositions contain the additives shown below and the balance of base oil. The base oil is predominately mixture of Yubase™-3 and Yubase™-6 oils (other than residual diluent oil factored out of the examples below). Approximately 42 wt % of the base oil mixture is Yubase™-3, 58 wt % of Yubase™-6.

| Additive | Lubricating Composition Additives (wt % on oil-free basis) | | | |
|---|---|---|---|---|
| | LC1 | LC2 | REF1 | REF2 |
| Preparative Example 4 | 1.61 | 0.76 | 3.22 | 0 |
| Preparative Example 8 | 1.61 | 3.10 | 0 | 3.22 |
| Corrosion Inhibitor | 0.02 | 0.02 | 0.02 | 0.02 |
| Phosphorus Antiwear Agents & Friction Stabiliser | 0.32 | 0.32 | 0.31 | 0.32 |
| Friction Modifier* | 1.11 | 1.01 | 0.63 | 1.11 |
| Antioxidant | 1.1 | 1.1 | 0.95 | 1.1 |
| Polymethacrylate Pour Point Depressant | 0.1 | 0.1 | 0.1 | 0.1 |
| Polymethacrylate Viscosity Modifier | 1.26 | 1.23 | 1.26 | 1.26 |
| Seal Swell Agent | 1.0 | 1.0 | 1.0 | 1.0 |
| Foam Inhibitor | 0.01 | 0.01 | 0.01 | 0.01 |

Footnote:
*the friction modifier comprises at least one additive prepared from Preparative Examples 1 to 3.

The lubricating compositions are evaluated using ASTM Method D130 (copper corrosion, at 150° C. for 3 hours); and Mercon®V Falex extreme pressure test (procedure 528.042.01, also referred to as ASTM D3233-93 (2003), employing method B); and Mercon®V 4-ball wear test (procedure 528.003.01, also referred to as ASTM D4172-94 (2002)). The data obtained is shown below in the table.

| Test | Test Conditions | LC1 | LC2 | RF1 | RF2 |
|---|---|---|---|---|---|
| Copper Corrosion | ASTM D130, 150° C., 3 hours | 1B | 1B | 1B | 3A |
| Mercon ®V Falex EP test | Average Load in kg, over two experiments at 100° C. | 795.5 (1750 lb) | 795.5 (1750 lb) | 681.8 (1500 lb) | 738.6 (1625 lb) |
| | Average Load in kg, over two experiments at 150° C. | 511.4 (1125 lb) | 568.2 (1250 lb) | 340.9 (750 lb) | 511.4 (1125 lb) |
| Mercon ®V 4-ball wear test | Wear Scar (μm) at 100° C. | 0.42 | 0.39 | 0.38 | 0.4 |
| | Wear Scar (μm) at 150° C. | 0.50 | 0.45 | 0.59 | 0.46 |

Footnote:
* ( ) values in pounds as measured during the Mercon ®V Falex EP test.

Overall the data indicates that the lubricating composition of the invention is capable of providing at least one property from acceptable friction performance and acceptable wear protection, acceptable corrosion resistance, acceptable anti-shudder performance, acceptable oxidation resistance and acceptable gear protection.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cyclo alkyl, cyclo alkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms; and (iv) heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a mechanical device, comprising supplying a lubricating composition to the mechanical device, wherein the mechanical device comprises an automatic transmission or a continuously variable transmission (CVT), and wherein the lubricating composition comprises:

(a) an oil of lubricating viscosity;

(b) a first dispersant comprising a product prepared by heating together:

(i) a first dispersant substrate, wherein the first dispersant is prepared from a succinic anhydride from an "ene" reaction, and wherein the first dispersant substrate comprises a succinimide dispersant prepared by reacting a hydrocarbyl-substituted succinic anhydride with a polyamine and having a CO:N ratio of about 1:1 to about 1:10;

(ii) a thiadiazole compound;

(iii) a borating agent;

(iv) terephthalic acid, and (v) optionally a phosphorus acid compound, said heating being sufficient to provide a product of (i), (ii), (iii) and (iv) and optionally (v), which is soluble in an oil of lubricating viscosity;

(c) a second dispersant, wherein 0 mole % to less than 50 mole % of the second dispersant molecules contain a carbocyclic ring, wherein the second dispersant is prepared from a succinic anhydride from an "ene" reaction, and wherein the second dispersant substrate comprises a succinimide dispersant prepared by reacting a hydrocarbyl-substituted succinic anhydride with a polyamine and having a CO:N ratio of about 1:1 to about 1:10;

(d) 0.005 wt % to 5 wt % of a corrosion inhibitor; and (e) 0.01 wt % to 6 wt % of a neutral or overbased detergent selected from a phenate, a sulphurised phenate, an alkylsalicylate, and a sulphonate.

2. The method of claim 1, wherein the corrosion inhibitor comprises an oil soluble 2,5-dimercapto-1,3,4-thiadiazole, other than (b).

3. The method of claim 1, wherein 0 mole % to less than 20 mole % of the second dispersant molecules contain a carbocyclic ring.

4. The method of claim 1, wherein the oil of lubricating viscosity has a sulphur content in range of 0 ppm to 1000 ppm.

5. The method of claim 1, further comprising a friction stabilising agent, wherein the friction stabilising agent comprises $H_3PO_4$, $H_3PO_3$ or mixtures thereof, and wherein the friction stabilising agent is present at 0.01 wt % to 0.5 wt % of the lubricating composition.

6. The method of claim 1, further comprising an antiwear agent selected from the group consisting of (i) a non-ionic phosphorus compound; (ii) an amine salt of a phosphorus compound; (iii) an ammonium salt of a phosphorus compound; (iv) a monovalent metal salt of a phosphorus compound, such as a metal dialkyldithiophosphate or a metal dialkylphosphate; and (v) mixtures of (i), (ii), (iii) or (iv).

7. The method of claim 1, further comprising an antioxidant, wherein the antioxidant comprises at least one of sulphurised olefins, hindered phenols, phenylalphanaphthylamines, alkylated diphenyl-amines, hydroxylalkyl sulphides, or mixtures thereof.

8. The method of claim 7, wherein the antioxidant is present at 0.01 wt % to 5 wt % of the lubricating composition.

9. The method of claim 1, wherein the lubricating composition further comprising a friction modifier.

10. The method of claim 9, wherein the friction modifier is present at 0.1 wt % to 4 wt %.

11. The method of claim 1, wherein the oil of lubricating viscosity has an aromatic content of 0 wt % to 10 wt %.

12. The method of claim 1, wherein the oil of lubricating viscosity has a viscosity index of 105 or more.

13. The method of claim 1, wherein the neutral or overbased detergent is a magnesium sulphonate or a calcium sulphonate present at 0.05 wt % to 4 wt % of the lubricating composition.

* * * * *